US007591733B1

(12) United States Patent
Kurisu

(10) Patent No.: US 7,591,733 B1
(45) Date of Patent: Sep. 22, 2009

(54) DEVICE FOR REDUCING EFFECT OF DOMINANT HAND ON GOLF SWING

(76) Inventor: Kazuo Kurisu, 76 Westbury St., Thousand Oaks, CA (US) 91360

( * ) Notice: Subject to any disclaimer, the term of this patent is extended or adjusted under 35 U.S.C. 154(b) by 0 days.

(21) Appl. No.: 12/218,970

(22) Filed: Jul. 21, 2008

(51) Int. Cl.
*A63B 69/36* (2006.01)

(52) U.S. Cl. ..... 473/206; 473/204

(58) Field of Classification Search ..... 473/201, 473/203, 204, 206, 219, 226, 300, 302, 303
See application file for complete search history.

(56) References Cited

U.S. PATENT DOCUMENTS 1,075,054 A * 10/1913 Morley ..... 473/206
1,530,596 A * 3/1925 Dye ..... 473/206
2,938,728 A * 5/1960 Green ..... 473/206
3,256,023 A * 6/1966 Frazelle ..... 473/206
3,533,630 A * 10/1970 Lo Monaco ..... 473/206
4,174,838 A * 11/1979 Paschetto ..... 473/238
5,143,375 A * 9/1992 Wilkins ..... 473/204
5,295,688 A * 3/1994 Montgomery ..... 473/206
5,762,563 A * 6/1998 Holzhausen ..... 473/206

* cited by examiner

*Primary Examiner*—Nini Legesse
(74) *Attorney, Agent, or Firm*—Irving Keschner

(57) ABSTRACT

A training device for use with a golf club. A mounting member enables the device to be mounted on the grip of a golf club. A positioning member is threadly engaged with a threaded post which is substantially perpendicular to the top surface of the mounting, the height of the positioner being adjustable to accommodate the hand size of the golfer.

2 Claims, 9 Drawing Sheets

DEVICE FOR REDUCING EFFECT OF DOMINANT HAND ON GOLF SWING

BACKGROUND OF THE INVENTION

1. Field of the Invention

The present invention provides a device attached to the shaft of a golf club that reduces the effect of the user's dominant hand on his/her golf swing and at the same time helps to define the correct swing path and impact timing.

2. Description of the Prior Art

It is well known that one of the most important elements and a key to a successful golf swing is the golfer's grip. The art of positioning the fingers, hands and pressure applied to the grip has been described numerous times. In addition, there have been many devices invented for the purpose of teaching and achieving an improved golf grip or swing.

The placement of hand and fingers on grip of club is rather easily accomplished by careful observation and following instructions. But the feeling of gripping a club and the amount and placement of pressure is very difficult to describe to an individual since each interprets and feels differently.

As simple as gripping a club is, it is the most recognized and believed to be the leading cause of an inconsistent golf swing. For an efficient swing, the importance of placement of fingers and hands is fundamental. But knowing the fundamental alone does not cure problems in inconsistency; most problems may be cured by understanding how the sub-dominant and dominant hand work together.

It is known that the sub-dominant hand leads and controls the path of the golf swing. However, many golfers tend to utilize the dominant side over the sub-dominant side, consciously or unconsciously, more than necessary. This can be caused by an increase of the grip pressure, usage of wrist, turning of the hand or even the body movement. Nervousness, anxiousness, desire, lack of concentration, . . . etc. can also cause this type of problem. The actual golf swing takes a very short time from start to finish and problems can occur anytime during the swing.

What is required to overcome these mistakes is to provide a device that is simple to use and allows the user to practice conveniently as possible and not to interfere in anyway with the practice swing and to be able to compare one's own swing to the correct swing and be able to repeat the corrected swing consistently for trust and self confidence.

One of the most common and leading cause of mistake in golf is the grip. In many cases, the positioning of the hand and its pressure applied to the grip will determine the swing path and the angle of the club head, especially at the point of impact with the golf ball. A golf swing uses every part of the body sequentially and/or simultaneously in continuous motion. Therefore, when the mistake occurs during the motion, it most likely creates another mistake that leads to others. The grip connects the user's body and the club and it is one of the most important elements of the resultant golf swing. The grip has to be securely connected and at the same time, be sensitive to the club feel.

The following illustrates how the grip and pressure effects the golf swing.

A. Positioning of Fingers and Hands:

Strong grip, which promotes the dominant hand to be active and most likely closes club face at impact.

Weak grip, which promotes an open club face at impact.

B. Place of and Amount of Pressure Applied:

Excess pressure, resulting in active hands.

Dominant hand takes authority of movement.

Arm and hand dominated swing, over the top, under cutting.

Premature turning of upper body.

Decrease swing speed.

Balance control.

Reverse Pivot.

SUMMARY OF THE INVENTION

The most common problems in having a successful golf swing is caused by an active dominant hand.

An effective golf swing requires that parts of the body be utilized differently than normally used for everyday life especially the dominant side of the body. The dominant hand has to be relaxed and the sub-dominant hand lead the swing.

The logic and theory are told and explained to the date but in reality even seasoned players occasionally make mistakes by letting the dominant hand be more active than necessary, a natural instinct of a typical golfer.

To overcome this instinct and the golf swing accordingly, the present invention provides a device attached to the golf club grip that is simple in design and simple to use. It is portable and can be used to compare the feeling of swing and correct an improper swing.

The device of the present invention provides the following advantages:

Able to go back and forth with device for quicker comparison and for better and faster learning.

Able to hit ball with device.

Better concentration for swing.

Better feel of impact zone, clearly and easy to understand body and hand position.

Better control of club head.

Better balance throughout the swing.

Better understanding of the timing of releasing the dominant side for power.

Better understanding of the role and task for the positions of the dominant hand.

Better understanding of where and what amount of pressure to apply on the grip.

Better chance to achieve, smooth and natural swing that fundamentally fits to an individual.

Exercise the proper use of power.

Exercise the feel of power transition, from leading (sub-dominant hand) to dominant hand.

Increase club head speed that leads to distance and spin to control the ball flight.

Learn role and task of sub-dominant hand.

Learn and understand the task of dominant hand.

Teaches proper movement (sequence of motion) fit to an individual's physical capabilities for the golf swing, leading to consistency and playing successful golf Understanding of position, angle of club head, and its affect.

The present invention will benefit all players, from beginners to advanced players.

A. For Beginners:

Ease of achieving smooth swing, which fit individual's physical capabilities.

Correct premature take-back and downswing by active dominant hand.

Learn how to use hands properly.

Utilizing sub-dominant and dominant hand the correct way.

Better feel of swing.

Better balancing, smooth, and consistent swing.

B. For Advanced Player:

Better understanding of relationship between club head and hand.

Ease of working on shot making.

Ease of correcting one's problem by themselves.

Improvement of direction, distance and timing, and for consistent and better golf Trusting own swing for confidence.

The device has a mounting member enabling the device to be secured to the golf club grip. A positioning member is threadly engaged with a threaded post which is substantially perpendicular to the top surface of the mounting, the height of the positioner being adjustable to accommodate the hand size of a golfer.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1:
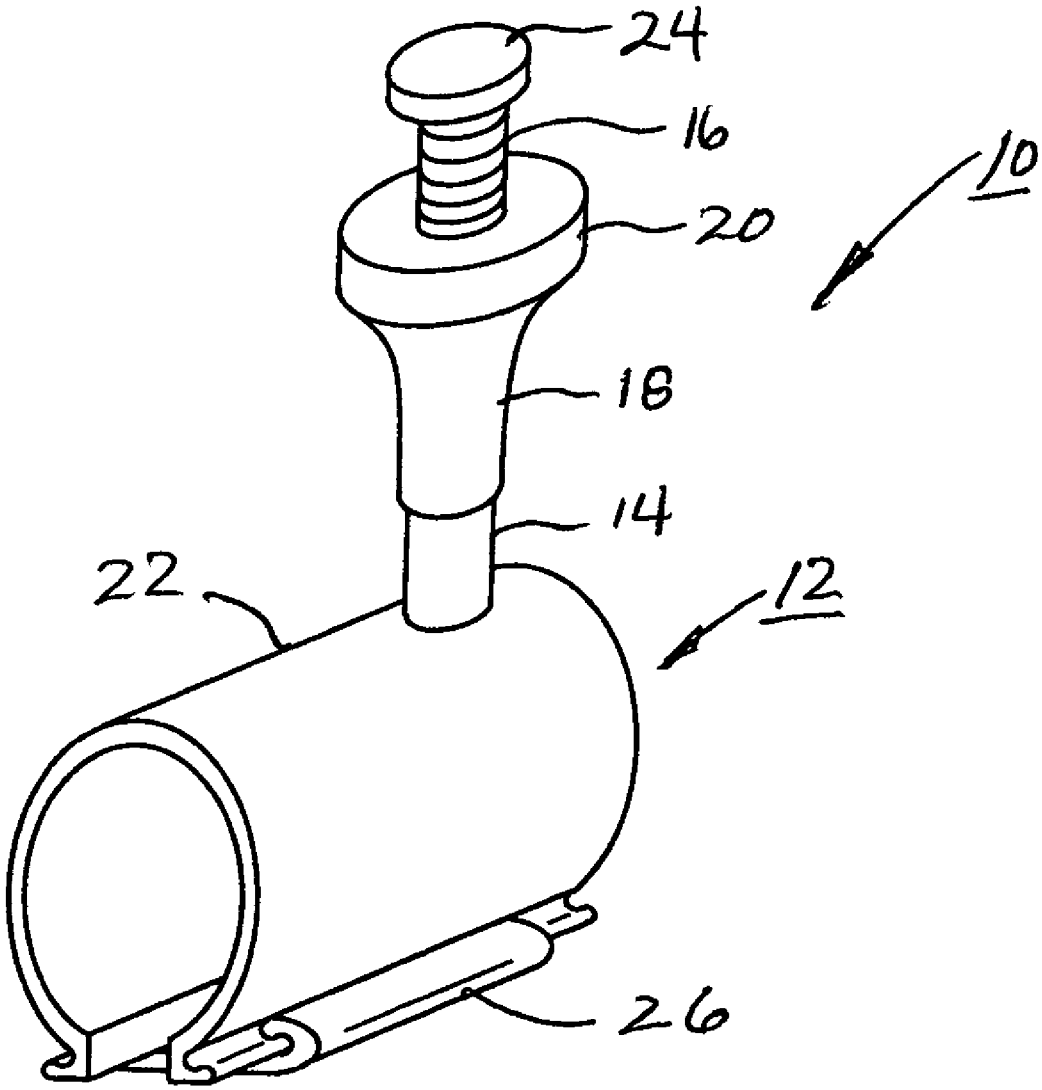
FIG. 1 is a perspective view of the device of the present invention.
Figure 2A:
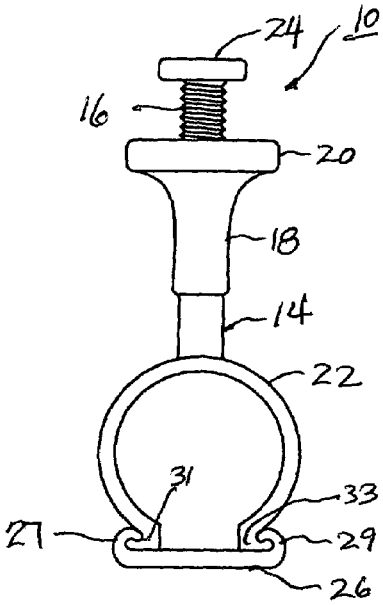
FIGS. 2A-2D are plan and sectional views of a first embodiment of the device shown in FIG. 1.
Figure 2B:
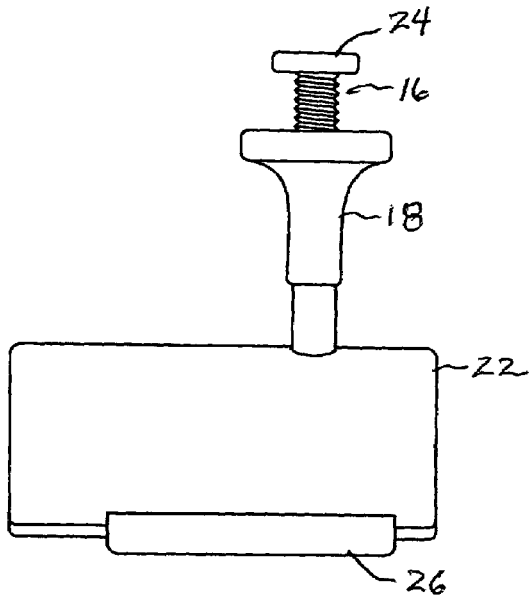
Figure 2C:
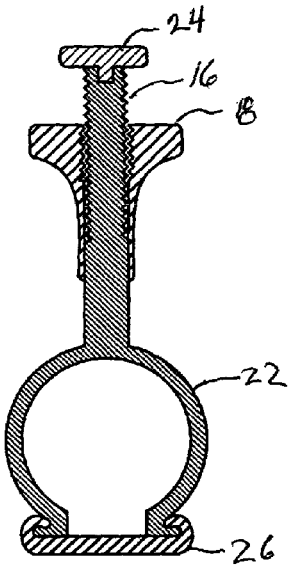
Figure 2D:
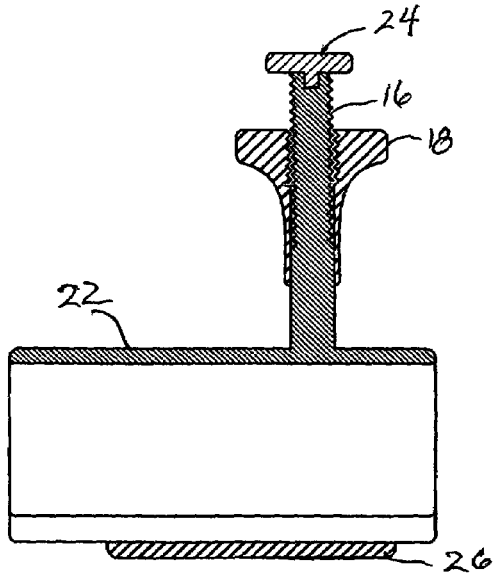
Figure 3A:
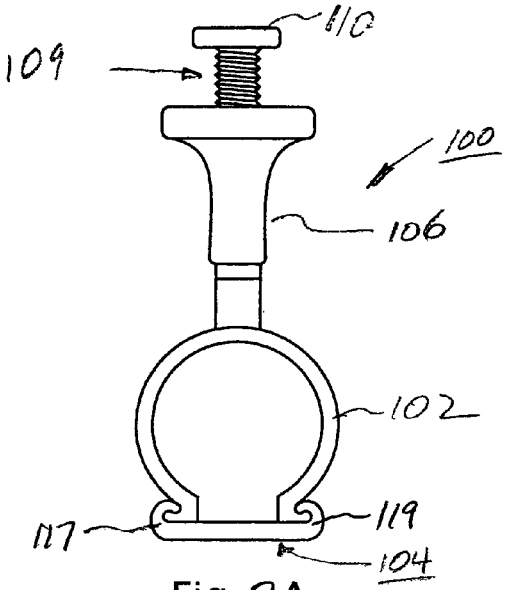
FIGS. 3A-3D are plan and cross-sectional views of a second embodiment of the device shown in FIG. 1.
Figure 3B:
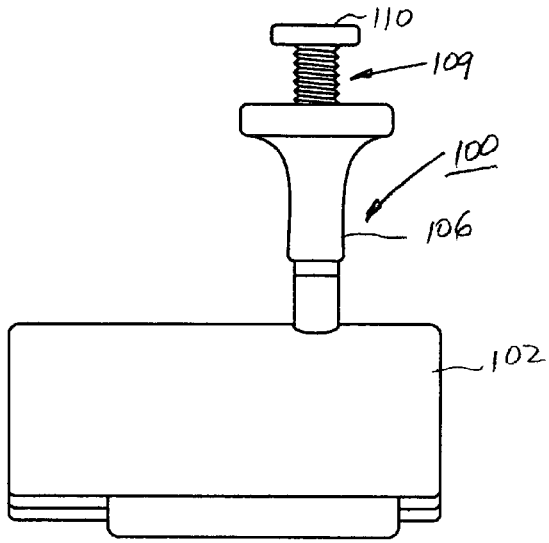
Figure 3D:
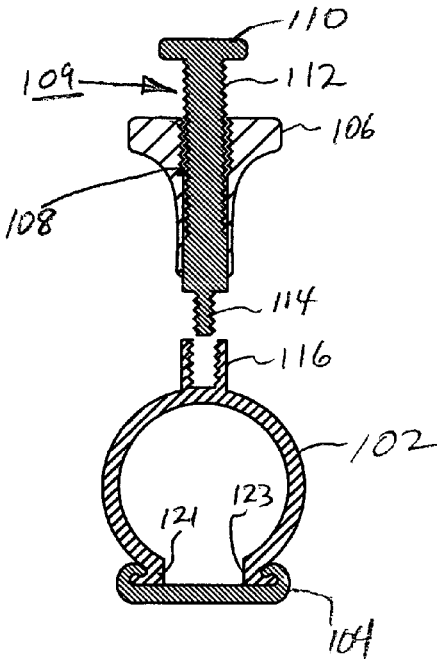
Figure 3C:
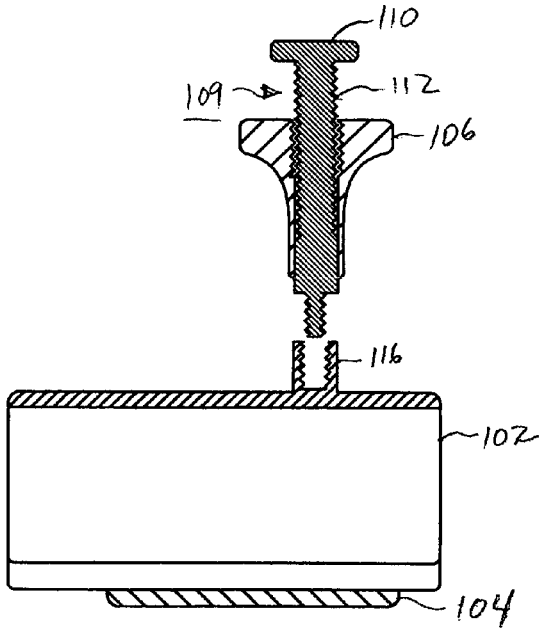

FIG. 1 is a perspective view of the device 10 of the present invention.

Device 10 comprises a mount 12 with a post member 14 secured to the top surface of mount 12, post member 14 having a threaded top portion 16. An adjustable grip positioner 18 is movable via threaded portion 16 to a position where a user's hand can be comfortably positioned between lip 20 of the positioner 18 and the top surface 22 of mount 12 as will be set forth hereinafter. A stopper 24 prevents the separation of positioner 18 from mount 12. Locking member 26 secures mount 12 in position on the golf club as will be described hereinafter.

Device 10 is designed to teach a player (left or right handed) the proper use of the sub-dominant and dominant hands, the relationship between hands, and the hand relationship between club-head and hands. These teachings enable a user to overcome many problems in his/her golf swing, help master the consistent swing that makes golf enjoyable and help users to concentrate on shot making instead of being worried about making contact with the golf ball.

A golf swing using the fundamental, or conventional, grip is conducted with both arms relaxed, extended and holding club lightly, the shoulder being turned to take back the golf club and letting the sub-dominant side (left for right handed and right for left handed) lead the swing.

The palm of the dominant hand is facing the target; at this position, the angle of the palm of the hand is the same angle as the leading edge of the club head. At the addressing stage, the club head is square to the direction of the target or perpendicular to its swing path. For the correct swing, as soon as the club head leaves the address position to the back swing, the golf club head starts to turn, or rotate, to the same angle as the swing path or plane and stays at the same angle.

The club head has to point to a certain direction during the swing such as the direction of the angle of the golf club leading edge, the same angle as of the swing plane and the same as the opened hand palm.

This open hand method is helpful to the learning process, since the player learns to concentrate only on the position or angle of the hand to know the position of the club head, instead of trying to adjust the club head by hand.

The device of the present invention does not control or maneuver the club or club head by hand but enables the club to act as the extension of the hand and thus enabling the club head react to or follow the hand.

Figure 6:
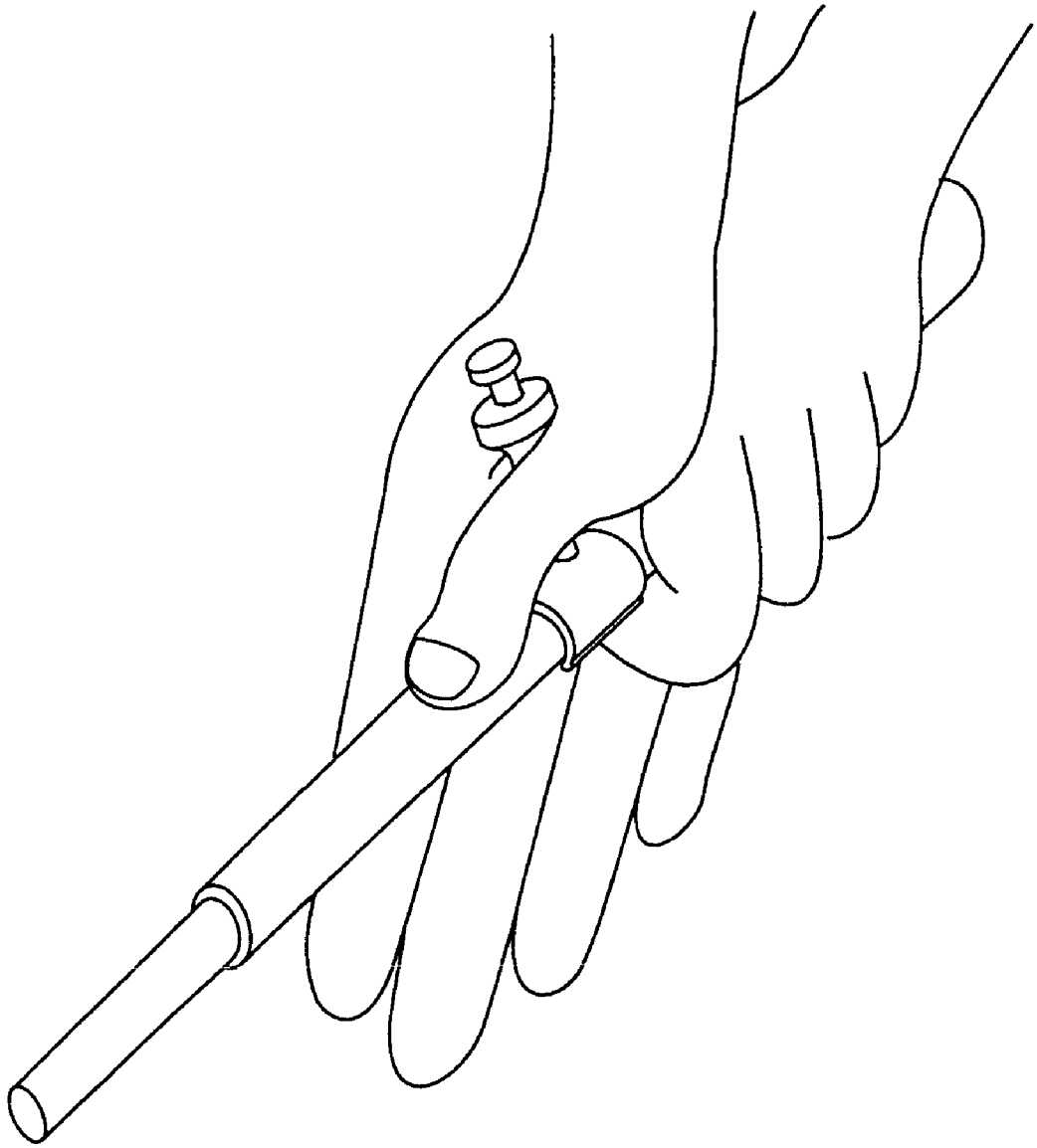
FIG. 6 illustrates the device of the present invention attached to the grip of a golf club where the thumb and index finger of a golfer's dominant hand is positioned in the V formed thereby the remaining fingers being extended.
Figure 7:
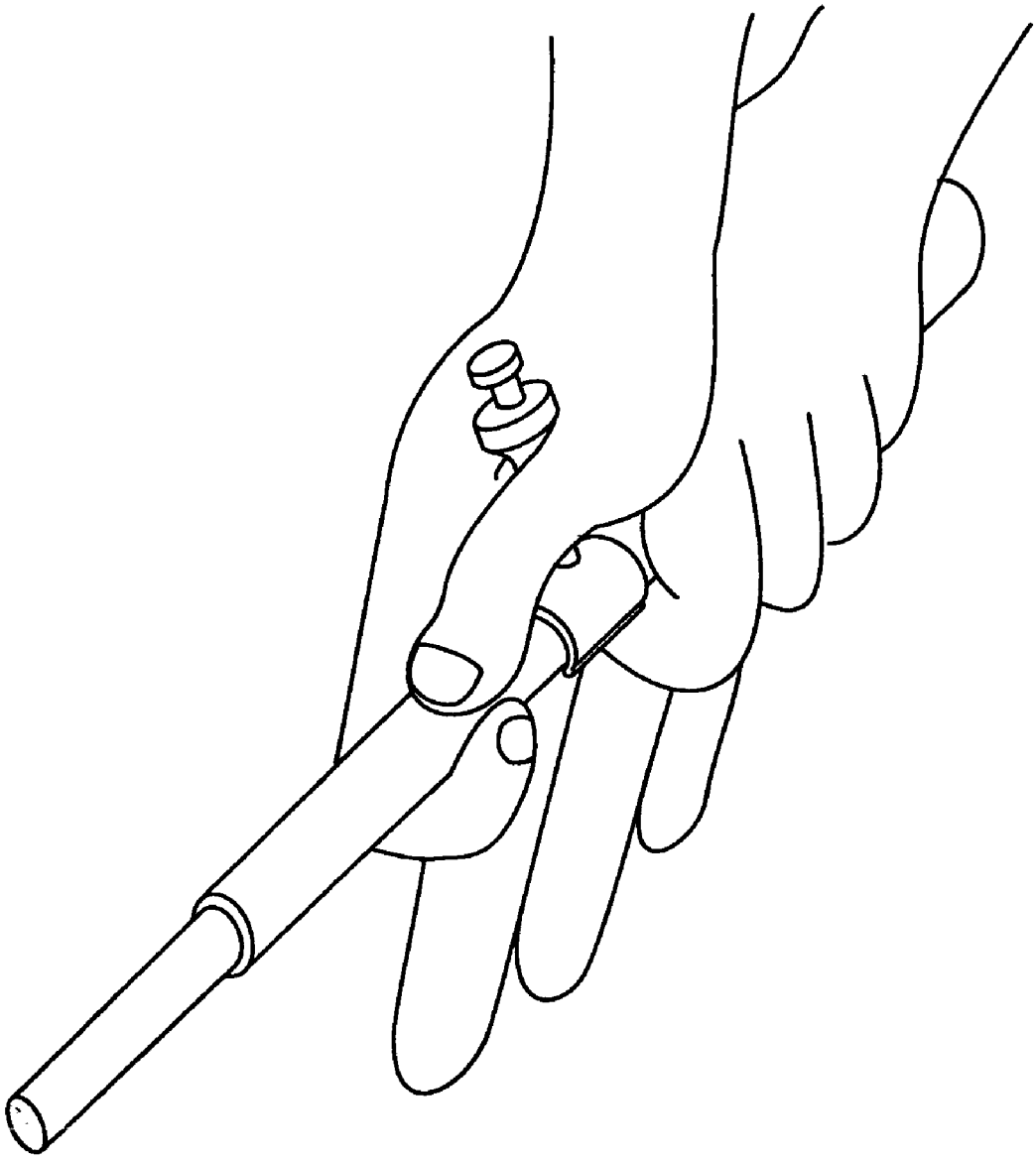
FIG. 7 illustrates the device of the present invention attached to the grip of a golf club wherein the thumb and index finger of a golfer's dominant hand is positioned in the V formed thereby, the index finger being hooked, the remaining fingers being extended.

Device 10 improves a golf swing by using a method of practicing the golf swing with an opened hand as shown in FIG. 6, or partially opened as shown in FIG. 7 with a hooked index finger and the rest of the fingers extended as shown. This method prevents the dominant hand from controlling the golf club by making the sub-dominant hand work harder and take the leading role in the swing.

Figure 8:
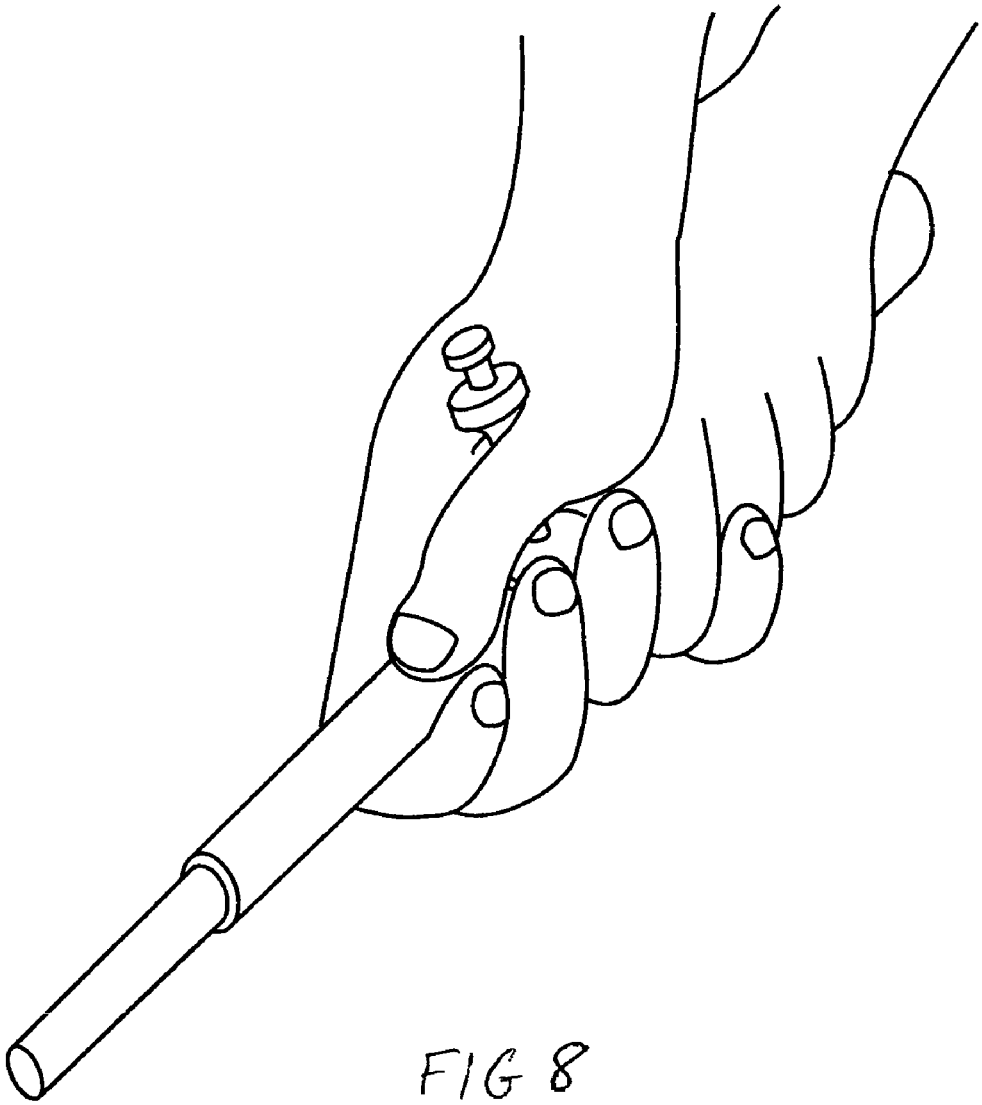
FIG. 8 illustrates the device of the present invention used with the over wrap grip shown in FIG. 5.

Device 10 is designed ergonomically to fit in the hand of a conventional golf grip, as shown in FIG. 8, with minimum interference with the swing (the device is for practice purposes only, not for a regulated golf game).

By attaching the device 10 to the golf club grip in the manner shown in FIGS. 4A-4D, device 10 is ready for use (note that lock 26 may be unnecessary in cases where mount 12 fits securely on the golf club grip). Positioner 18 is adjusted by being moved up or down to a position individualized to a particular player such that the club will stay attached when a player's hands are opened but the "V" formed between the index finger and thumb of dominant hand is closed.

Device 10 is compact in size and can fit most clubs and the user need not carry any extra equipment to practice on his/her own. Device 10, in addition to be used for practice, can be used to address and hit the golf ball on and off golf courses.

FIGS. 3A-3D illustrate a second embodiment of the present invention. In particular, device 100 comprises mount 102, lock 104, adjustable grip positioner 106 having an interior threaded portion 108, stopper 110, threaded screw 109 having portions 112 and 114 and short internally threaded post 116 protruding from the outer surface of positioner 102.

In use, positioner 106 is rotated such that it moves along the threaded screw 109 to the proper user position.

Device 100 is portable and mount 102 and lock 104 can be positioned and remain on the club grip during practice.

Figure 5:
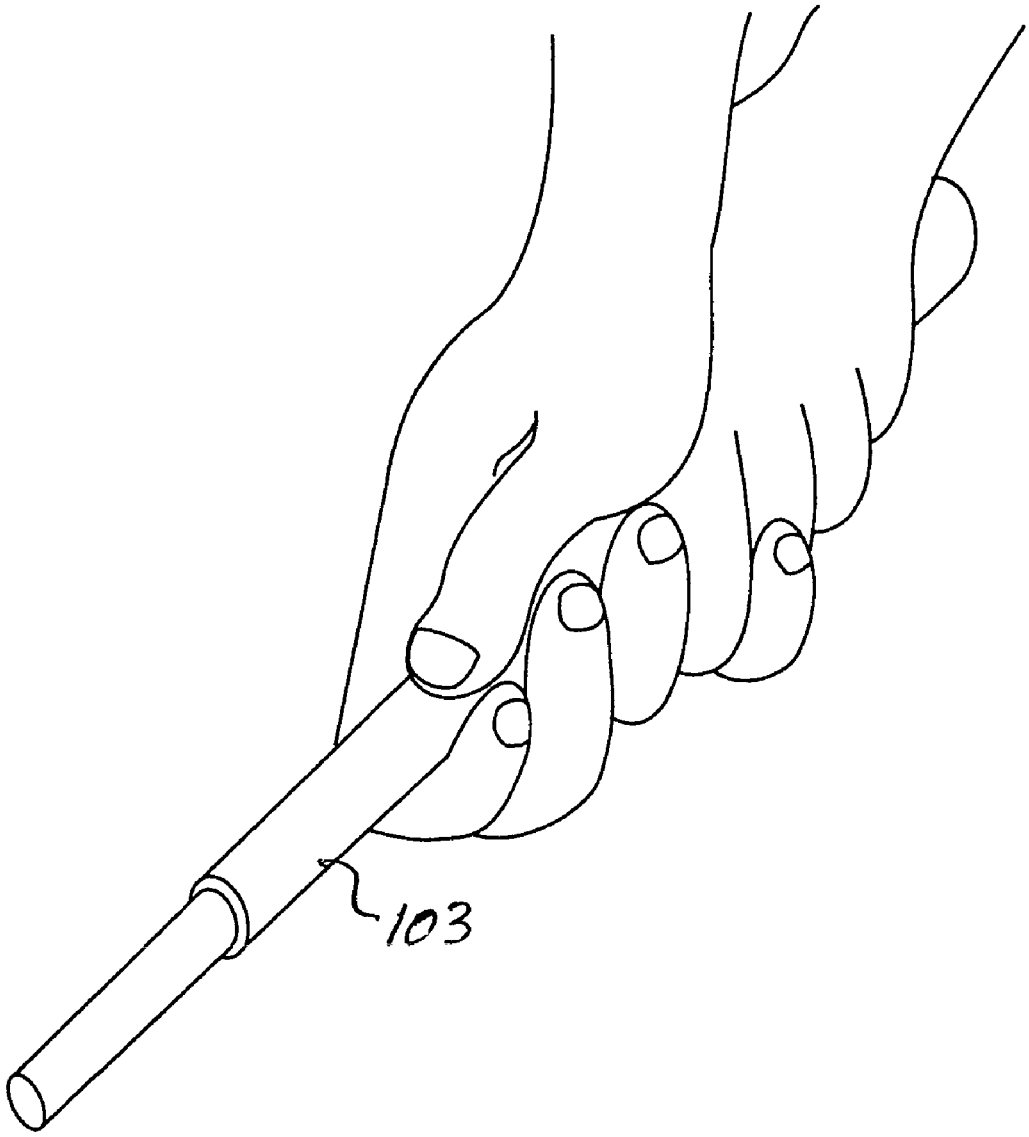
FIG. 5 illustrates the most common grip used by golfers, wherein the pinky of the golfers dominant hand over wraps and is positioned between the index and middle finger of the golfers sub-dominant hand.

Mount 102, because of short post 116, can remain secured to the golf club (preferably on the golf grip 103 as shown in FIG. 5) grip and stored in a conventional golf bag with minimum interference. When required for practice, post 109 is screwed on mount 102 via threaded portion 114, post 109 already having been adjusted to the proper position within positioner 106 and practice conducted in the same manner as with device 10, discussed hereinabove.

Lock 104 (identical to lock 26 shown in FIGS. 1 and 2) has curved portions 117 and 119 forming channels along their length. Cylindrically shaped mount 102 has lower foot shaped members 121 and 123 along its length.

Figure 4A:
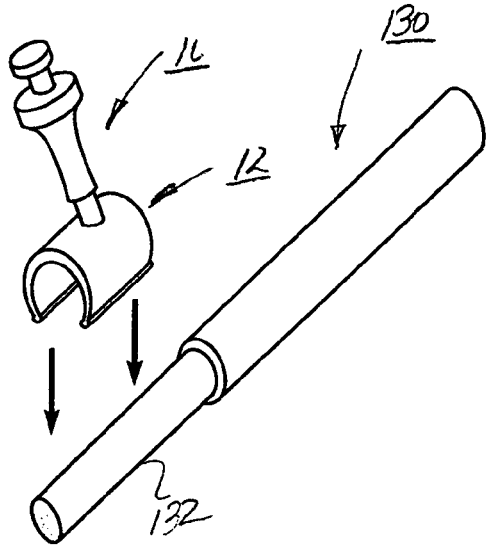
FIGS. 4A-4D illustrates the steps for attaching the device of the present invention to a golf club grip.
Figure 4B:
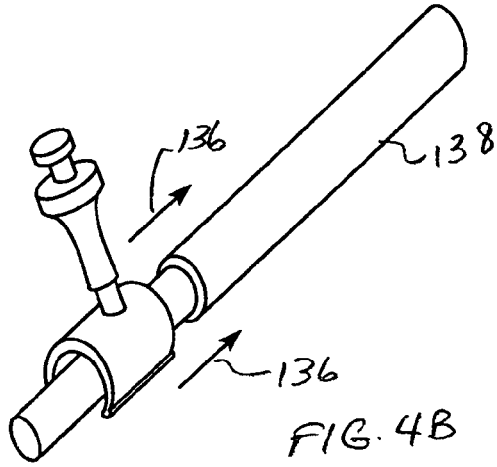
Figure 4C:
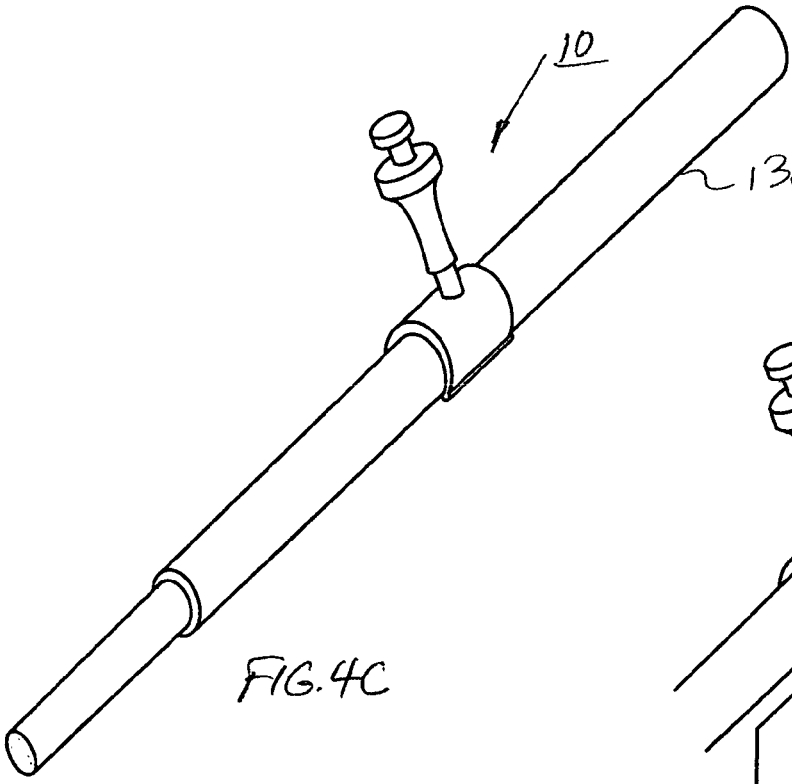
Figure 4D:
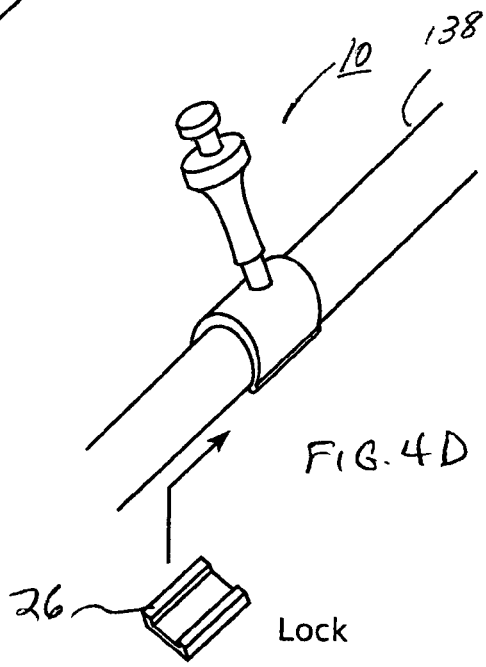

FIGS. 4A-4D illustrate the sequence used in attaching and securing mount 12 to the grip of a golf club (the description that follows is the same for securing mount 102). In particular, device 10 is first positioned over the shaft 132 of golf club 130 (FIG. 4A) and then moved in direction of arrows 136 towards golf club grip 138 (FIG. 4B). Device 10 is then moved to an appropriate position on grip 138 (FIG. 4C) and, if necessary, lock 26 is moved in a manner (FIG. 4D) such that the channels formed by curved portions 27 and 29 therein engage foot shaped members 31 and 33, respectively, on mount 22 as shown in FIG. 1.

Figure 9A:
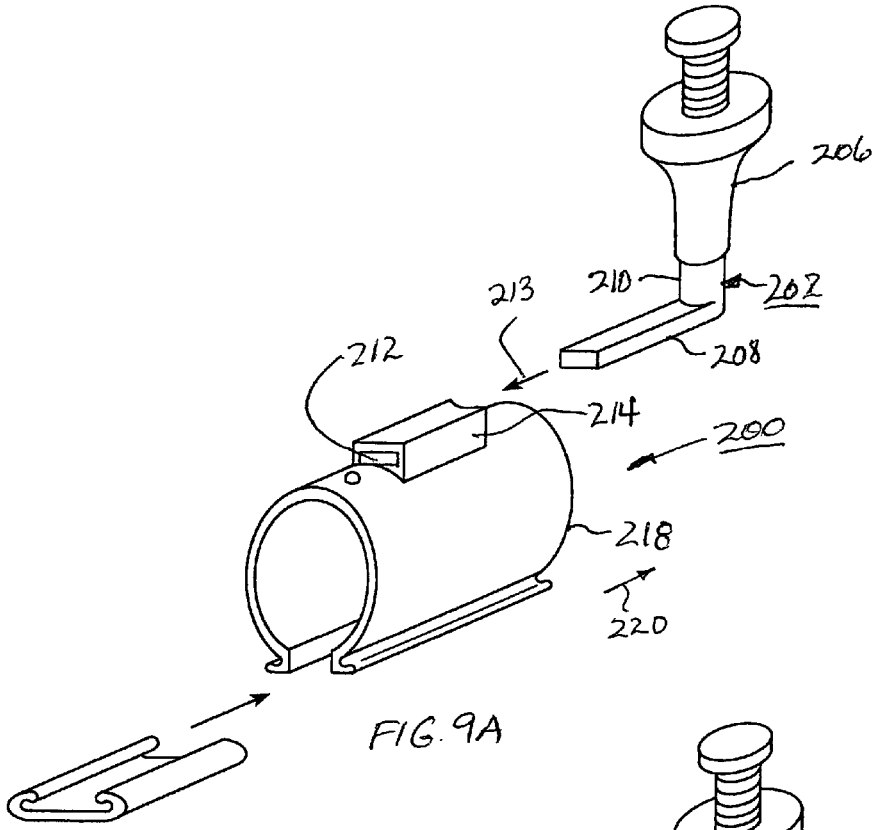
FIGS. 9A-9C illustrate a third embodiment of the present invention.
Figure 9B:
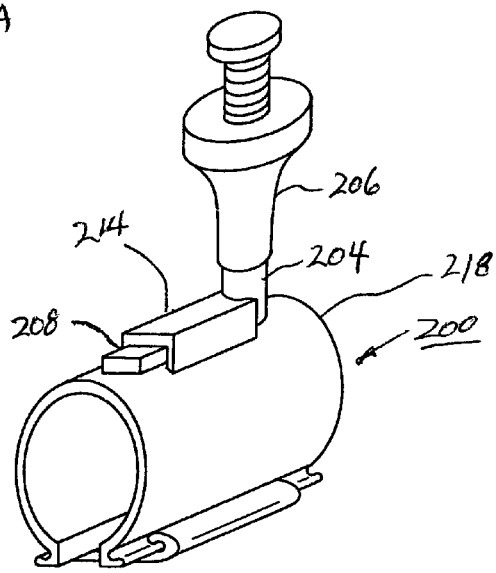
Figure 9C:
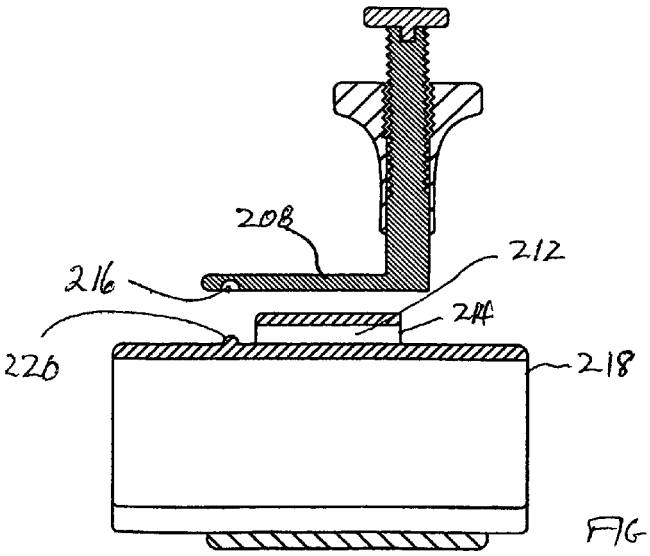

Referring not to FIGS. 9A-9C, a third embodiment of the present invention is illustrated. In essence, device 200 is similar to the version shown in FIGS. 3A-3D with the addition of a quick release post 202 in order to expedite the attachment/release of post to/from adjustable grip positioner 206. Post 202 is L-shaped and comprises legs 208 and 210, leg 208 sliding into a channel 212 formed in member 214. The bottom surface of leg 208 has an opening 216 formed therein. The top surface of positioner 218 has a vertically movable protrusion, or dimple, 220 formed thereon. The post 202 is secured to the mounting plate by a user inserting leg 208 into channel 212 (direction of arrow 213) in a manner such that protrusion 220 clicks into opening 216. A user can remove device post 202 by pulling the post in direction indicated by arrow 220. In this case, protrusion 218 retracts enabling the post to be removed.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A device for reducing the effect of a golfer's dominant hand on his/her golf swing comprising:

a cylindrical shaped member having an opening which extends along the length of said shaped member, said shaped member being mounted on a golf club;

an L-shaped post member having first and second leg portions; and an adjustable grip positioner having first and second ends, said first leg portion being operatively coupled to said adjustable grip positioner, said second leg portion being coupled to said shaped member; wherein said shaped member has an outer surface and a receiving member with a channel thereon, said receiving member being positioned on the outer surface of said shaped member, said first leg portion of said post member extending into the channel; wherein said first leg portion has upper and lower surfaces and extends through said channel, and said lower surface have a cavity formed therein.

2. The device of claim 1 wherein the surface of said shaped member has a protrusion formed thereon adjacent said receiving member, and said protrusion extends into said cavity when said first leg portion is extended into the channel.

* * * * *